US011772748B2

(12) United States Patent
Fuller, IV et al.

(10) Patent No.: US 11,772,748 B2
(45) **Date of Patent: *Oct. 3, 2023**

(54) MOTORIZED SLIDE SYSTEM FOR MANIPULATING A COMPONENT OF A BOAT

(71) Applicant: PB Holdco, LLC, Ft. Pierce, FL (US)

(72) Inventors: Linwood Addison Fuller, IV, Vero Beach, FL (US); Christopher M. Gratz, Stuart, FL (US); Adrian William Abadie, Vero Beach, FL (US)

(73) Assignee: PB Holdco, LLC, Ft. Pierce, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/658,128

(22) Filed: Apr. 6, 2022

(65) Prior Publication Data

US 2022/0227462 A1 Jul. 21, 2022

Related U.S. Application Data

(63) Continuation of application No. 16/860,820, filed on Apr. 28, 2020, now Pat. No. 11,319,027.

(60) Provisional application No. 62/841,572, filed on May 1, 2019.

(51) Int. Cl.

| | |
|---|---|
| ***B63B 19/18*** | (2006.01) |
| ***B63B 3/48*** | (2006.01) |
| ***B63B 17/00*** | (2006.01) |

(52) U.S. Cl.

CPC ..... *B63B 19/18* (2013.01); *B63B 3/48* (2013.01); *B63B 2003/485* (2013.01); *B63B 2017/0054* (2013.01); *E05Y 2900/514* (2013.01)

(58) Field of Classification Search

CPC ..... B63B 19/00; B63B 19/12; B63B 19/14; B63B 19/18; B63B 19/19; B63B 19/203; B63B 3/00; B63B 3/48; B63B 2003/485; B63B 17/00; B63B 2017/0054; E05Y 2900/514

USPC ..... 114/114, 85, 201 R, 202, 203, 343, 364

See application file for complete search history.

(56) References Cited

U.S. PATENT DOCUMENTS

| | | | | |
|---|---|---|---|---|
| 2,194,012 | A | 3/1940 | Dawson | |
| 3,183,874 | A | 5/1965 | Barlow | |
| 3,312,990 | A | 4/1967 | Lapworth | |
| 4,425,861 | A | 1/1984 | Raikamo | |
| 5,088,435 | A * | 2/1992 | Lathers | B63B 19/18 114/178 |
| 6,568,342 | B2 | 5/2003 | Mielke et al. | |
| 6,574,911 | B1 | 6/2003 | Hurst et al. | |
| 6,880,480 | B2 | 4/2005 | Clouse | |
| 9,688,358 | B2 * | 6/2017 | Fuller, IV | B63B 19/18 |
| 9,919,767 | B2 * | 3/2018 | Reid | E05F 15/649 |

* cited by examiner

*Primary Examiner* — Daniel V Venne
(74) *Attorney, Agent, or Firm* — Honigman LLP

(57) ABSTRACT

A slide system includes a component assembly, a track system, a floor panel, and a below-deck cavity. The track system is coupled at least indirectly to the component assembly for guiding movement of the component assembly along a path. The floor panel includes an upper surface. The below-deck cavity is disposed below the floor panel. The component assembly is located substantially above the floor panel. The track system is located within the below deck cavity and below the upper surface.

18 Claims, 7 Drawing Sheets

MOTORIZED SLIDE SYSTEM FOR MANIPULATING A COMPONENT OF A BOAT

CROSS REFERENCE TO RELATED APPLICATIONS

This application is a continuation of U.S. application Ser. No. 16/860,820 filed Apr. 28, 2020, issued as U.S. Pat. No. 11,319,027, on May 3, 2022, which claims priority under 35 U.S.C. § 119(e) to U.S. Provisional Application 62/841,572 filed on May 1, 2019, the contents of which are incorporated herein by reference in their entireties.

FIELD

The present disclosure relates generally to systems and methods for manipulating vehicle components, and more particularly manipulation systems and methods for re-positioning boat components for maximizing the efficient use of space on a boat deck or the like.

BACKGROUND

This section provides background information related to the present disclosure and is not necessarily prior art.

Vehicles, particularly boats, by their nature, offer a limited amount of space for arranging components such as equipment, furniture (e.g., seats, containers, etc.), and the like. Accordingly, a robustly engineered packaging and arrangement of such components can allow for the efficient and functional use of the available space on the vehicle. While known systems for arranging such vehicle components have proven acceptable for their intended purpose, there remains a continuous need for improvement in the pertinent art.

SUMMARY

This section provides a general summary of the disclosure, and is not a comprehensive disclosure of its full scope or all of its features.

One aspect of the disclosure provides forth a system for manipulating one or more boat structures to efficiently use critical deck space when certain functions are required and to relinquish that space when those functions are no longer needed. Additionally, because of the tight quarters commonly found on boats, poorly located objects such as walls, equipment, furniture, etc. can pose inconveniences and in some cases, hazards.

Another aspect of the disclosure provides a seat manipulating system that is largely located below the boat deck with minimum penetration above the boat deck, thereby essentially eliminating all trip hazards.

Another aspect of the disclosure provides a component assembly. The component assembly may include a drive mechanism at least indirectly coupled to the component assembly. The component assembly may be manipulatable along a path by the associated drive mechanism. A track/slide system may be coupled at least indirectly to the component assembly for guiding the movement of the component assembly along the path. A below-deck cavity structure supports the associated drive mechanism. The component assembly may be located substantially above a floor panel having an upper surface. The drive mechanism and the track/slide system may be located within the below deck cavity structure and below the upper surface.

Yet another aspect of the present disclosure provides a slide system. The slide system includes a component assembly, a track system, a floor panel, and a below-deck cavity. The track system is coupled at least indirectly to the component assembly for guiding movement of the component assembly along a path. The floor panel includes an upper surface. The below-deck cavity is disposed below the floor panel. The component assembly is located substantially above the floor panel. The track system is located within the below deck cavity and below the upper surface.

Implementations of this aspect of the disclosure may include one or more of the following optional features. In some implementations, the slide system includes a drive mechanism at least indirectly coupled to the component assembly. The component assembly may be manipulatable along the path by the drive mechanism. In some implementations, the slide system includes a motor operable to actuate the drive mechanism. In some implementations, the drive mechanism includes a cable coupled to the motor and the component assembly. The cable may be configured to move the component assembly relative to the floor panel.

In some implementations, the component system includes at least one of a seat or an entertainment system.

In some implementations, the track system includes a first portion and a second portion configured to translate relative to the first portion. The first portion may be fixed within the cavity. The second portion may be coupled to the component assembly for translation therewith.

In some implementations, the floor panel defines a slit. The slide system may also include a support structure coupled to the component assembly and the track system. The support structure may be at least partially disposed within the slit. The support structure may include a lateral section and an upper wall extending from the lateral section. At least a portion of the lateral section may be disposed below the upper surface. The upper wall may be disposed above the upper surface. The floor panel may be disposed between the upper wall and the cavity relative to a direction extending perpendicular to the path.

Another aspect of the disclosure provides a slide system. The slide system may include a deck, a floor panel, a track system, and a support structure. The deck may define a cavity and an opening in communication with the cavity. The floor panel may cover a portion of the opening. The deck and the floor panel may define a slit. The track system may be disposed within the cavity. The support structure may be coupled to the track system and include a portion translatably disposed within the slit. The track system may be configured to move the portion of the support structure within the slit.

This aspect may include one or more of the following optional features.

In some implementations, the slide system includes a component assembly coupled to the support structure. The component assembly may be located substantially above the floor panel. The track system may be located below the floor panel. The component assembly may include at least one of a seat or an entertainment system.

In some implementations, the slide system includes a drive mechanism at least indirectly coupled to the support structure. The support structure may be manipulatable along a path by the drive mechanism. In some implementations, the slide system includes a motor operable to actuate the drive mechanism. The drive mechanism may include a cable coupled to the motor and the support structure. The cable may be configured to move the support structure relative to the floor panel.

The track system may include a first portion and a second portion. The second portion may be configured to translate relative to the first portion. The first portion may be fixed within the cavity. The second portion may be coupled to the support structure for translation therewith.

In some implementations, the support structure includes a lateral section and an upper wall extending from the lateral section. At least a portion of the lateral section may be disposed below the floor panel. The upper wall may be disposed above the floor panel. The slit may extend in a travel direction. The floor panel may be disposed between the upper wall and the cavity relative to a direction extending perpendicular to the travel direction.

Yet another aspect of the disclosure provides a slide system. The slide system may include a component assembly, a track system, a floor panel, and a cavity. The track system may be coupled to the component assembly and define a path of movement of the component assembly. The floor panel may include an upper surface and be disposed between the component assembly and the track system. The cavity may be disposed below the floor panel. The component assembly may be disposed above the floor panel. The track system may be located within the cavity and below the upper surface.

This aspect may include one or more of the following optional features.

In some implementations, the floor panel defines a slit. The slide system may also include a support structure coupled to the component assembly and the track system and at least partially disposed within the slit.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

Figure 1:
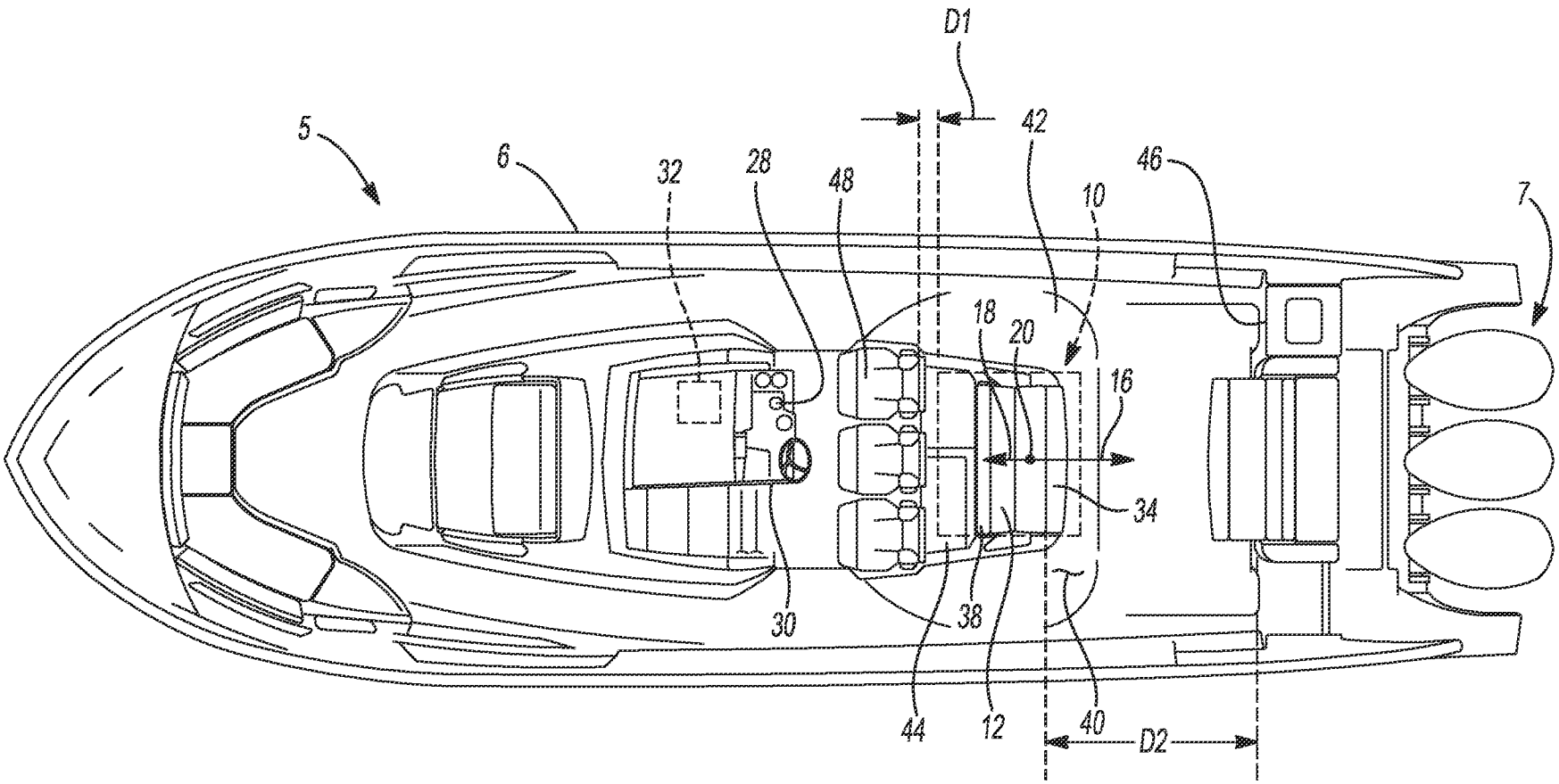
FIG. 1 is a plan view of a vehicle including a slide system in accordance with the principles of the present disclosure.

Referring to FIG. 1, a vehicle 5 including a body 6, an engine 7, and a slide system 10 is shown. While the vehicle 5 is shown and described herein as being a motorized watercraft (e.g., a boat), the vehicle 5 may include an automobile, a bus, or other suitable form of transportation within the scope of the present disclosure.

Figure 3:
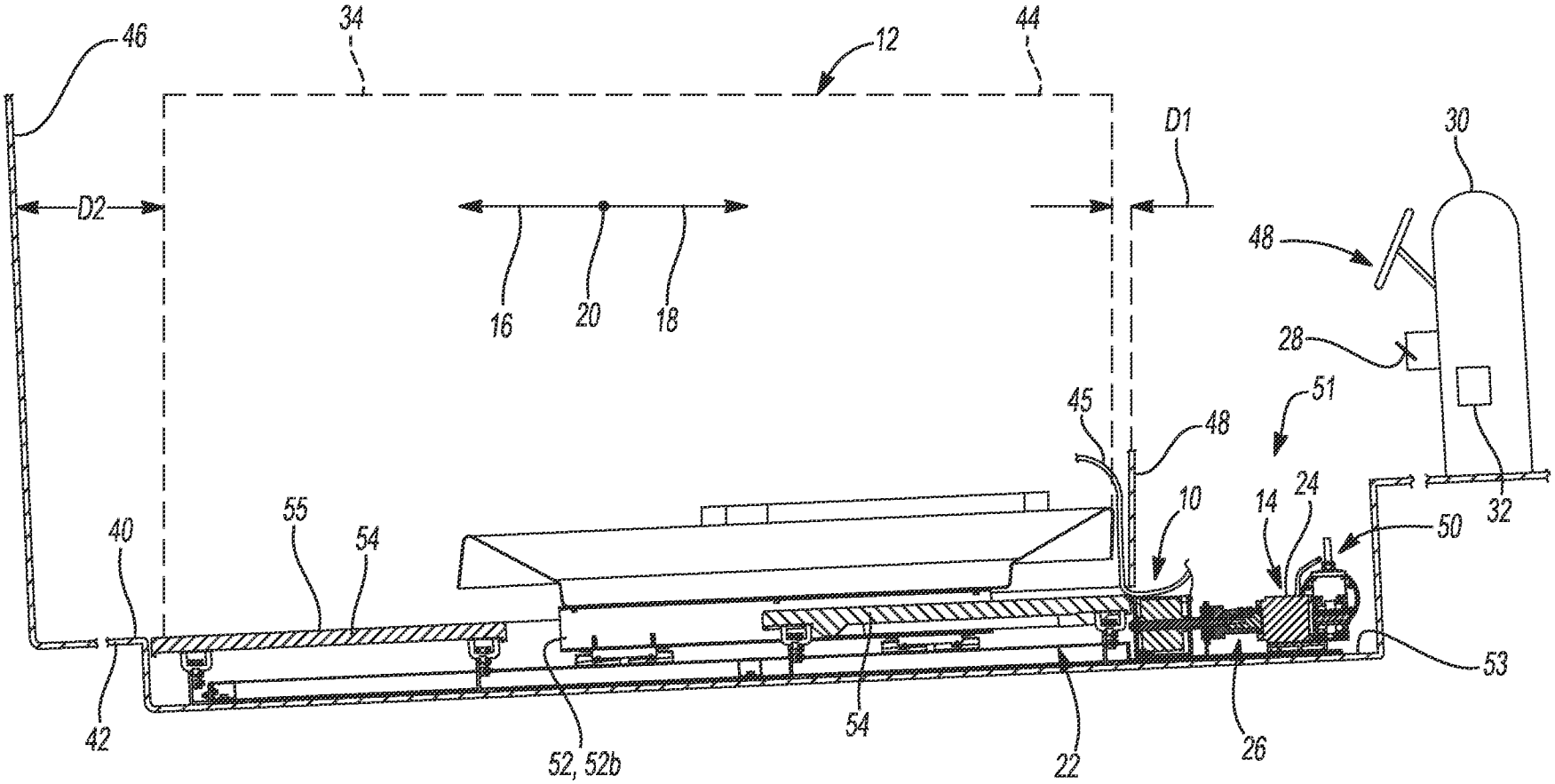
FIG. 3 is a schematic elevational view of a side of the slide system of FIG. 1.

The slide system 10 includes a seat/entertainment system assembly 12 and an associated drive mechanism 14. As will be explained in more detail below, the seat/entertainment system assembly 12 can be manipulated along a path 20 comprised of a reverse travel direction 16 and a forward travel direction 18. For example, as illustrated in FIGS. 3-6, the seat/entertainment system assembly 12 may ride (e.g., translate) upon a track/slide system 22. In particular, the seat/entertainment assembly 12 may be manipulated along the reverse direction 16 and the forward direction 18 by way of a drive motor 24 and associated drive linkage 26. With reference to FIGS. 1 and 3, the manipulation of the drive motor 24 can be accomplished by way of toggling a control switch 28 in a fore or aft position, which may be respectively associated with moving the seat/entertainment system assembly 12 in the reverse 16 or forward 18 direction. The control switch 28 can be mounted in any convenient location, including on a control console 30 of the vehicle 5. The control switch 28 interfaces with a motor controller 32, which, in turn, is connected electrically to, and communicates with, the drive motor 24. Methods and systems for using a fore/aft electric switch to control the reverse/forward rotational direction of a motor are well known to those skilled in the art, the details of which are not discussed any further herein.

The seat/entertainment system assembly 12 can be comprised of any number of components including a first seat 34 and a second seat. In this arrangement, the second seat could be attached back-to-back to the first seat 34 such that the second seat is completely supported (e.g., cantilevered) from a backrest portion 38 of the first seat 34. By arranging the first seat 34 and the second seat in this way, the second seat may be free-floating and not contact an outer walking surface 40 of a deck 42 of the vehicle 5.

With reference to FIGS. 1 and 3, in some implementations, the seat/entertainment system assembly 12 includes other components. For example, the seat/entertainment system assembly 12 may include an entertainment system structure 44. In this regard, the first seat 34 may support the entertainment system structure 44. Specifically, the first seat 34 can support (e.g., cantilevered), the entertainment system structure 44 for housing a sink, a grill, (sink and grill not shown) or any other system used on the vehicle 5. Depending on the type of system which is housed in the entertainment system structure 44, various services may be necessary to run to, and to run from, the entertainment system structure 44. In this regard, as illustrated in FIG. 3, the vehicle 5 may include one or more service conduits/lines 45 (e.g., a gas line for fueling a grill, hot and cold water service conduits for a sink, a wastewater drain system conduit for the sink, electrical service conduits for powering an electric grill, garbage disposal, or any other electrical device located within the entertainment system structure 44).

The seat/entertainment system assembly 12 is manipulatable along the path 20. For example, as illustrated in FIGS. 1 and 3, the seat/entertainment system 12 may be located between a wall 46 and one or more other seats 48 or other structures (e.g., a steering wheel). When there is no need to access the entertainment system structure 44, the seat/entertainment system assembly 12 can be manipulated such that a space or distance D1 measured along (e.g., parallel to) the path 20 between the seat/entertainment system 12 and the one or more other seats 48 can be minimized. This allows a space or distance D2 measured along (e.g., parallel to) the path 20 between the seat/entertainment system 12 and the wall 46 to be maximized for use as an aisle way, for access to the motor or other area of the vehicle 5, for accessing other controls, etc. On the other hand, when a user desires to access the entertainment system assembly 12 (e.g., the entertainment system structure 44), the user can manipulate the control switch 28 such that the seat/entertainment system assembly 12 is manipulated in the reverse direction 16, thereby minimizing the distance D2 and maximizing the distance D1.

Now referring to FIGS. 3 and 5A-6, optionally, the drive mechanism 14 is located in a cavity 50, which is located completely below the walking surface 40 of the deck 42. In this regard, the deck 42 may define an opening 51 in the walking surface 40. The opening 51 may be in fluid communication with the cavity 50. Optionally, the only portion of the drive mechanism 14 that extends above the walking surface 40 is a support structure 52 for supporting the seat/entertainment system assembly 12 (e.g., the first seat 34 and/or the entertainment system structure 44). In some implementations, the support structure 52 is a bent plate. In this regard, the support structure 52 may be referred to herein as the bent plate 52. In some implementations, the deck 42 includes a narrow slit 59 disposed between a floor panel 54 (e.g., a floor panel edge 56 of the floor panel 54) and the deck 42 (e.g., a deck edge 58 of the deck 42). In this regard, the slit 59 may be the only opening between the floor panel edge 56 and the deck edge 58. The narrow slit 59 does not have to be any wider than necessary to allow for the width W (FIG. 6) of the bent plate 52 to pass therethrough from the cavity 50.

Figure 5A:
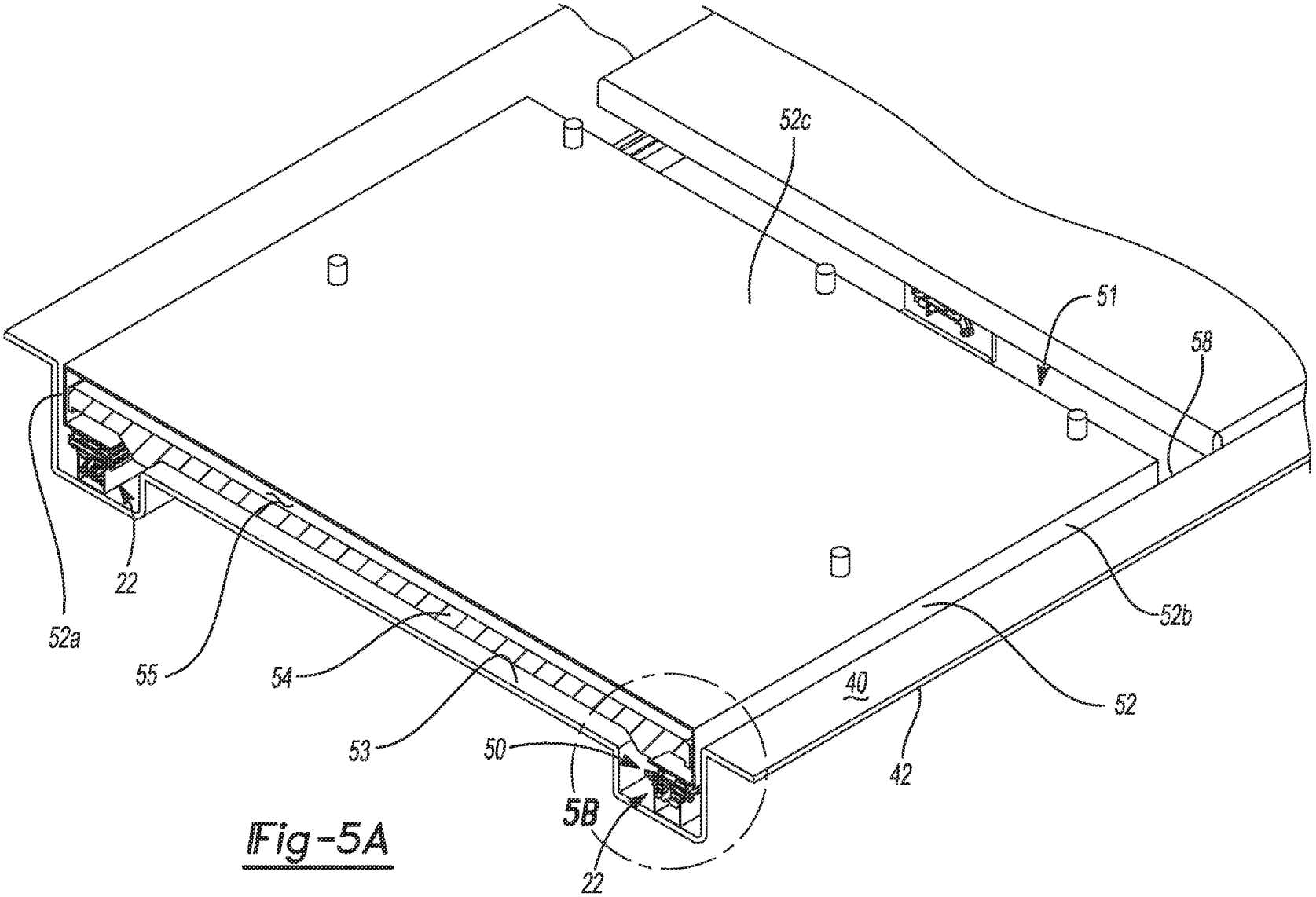
FIG. 5A is a cross-sectional perspective view of a portion of the slide system of FIG. 1.
Figure 5B:
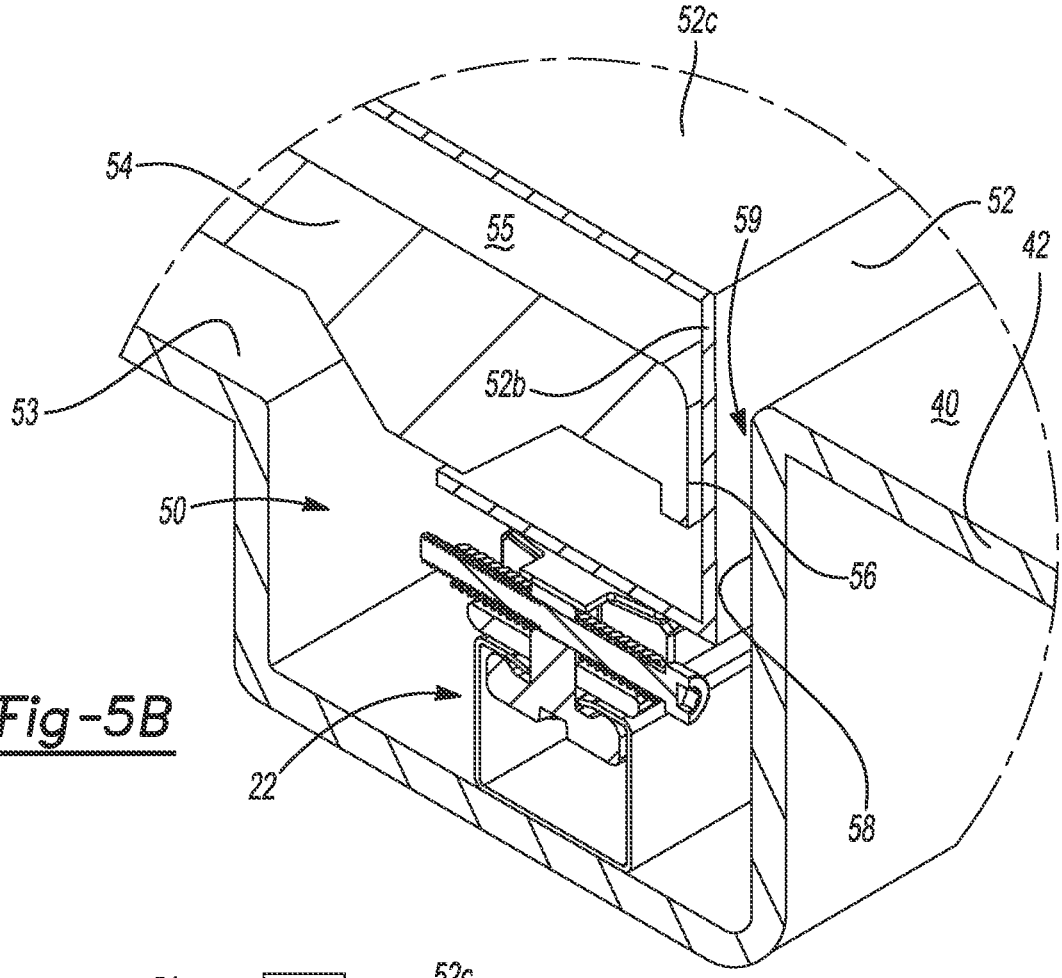
FIG. 5B is an enlargement of portion 5B of FIG. 5A.
Figure 5C:
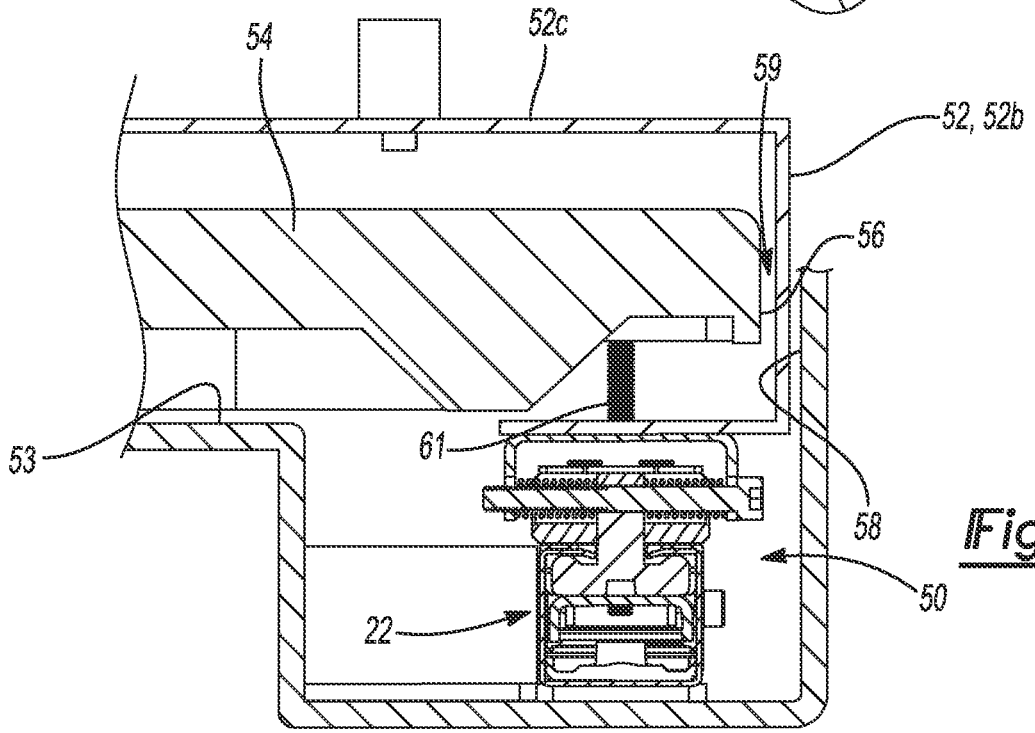
FIG. 5C is a cross-sectional elevation view of the portion 5B of FIG. 5A.
Figure 6:
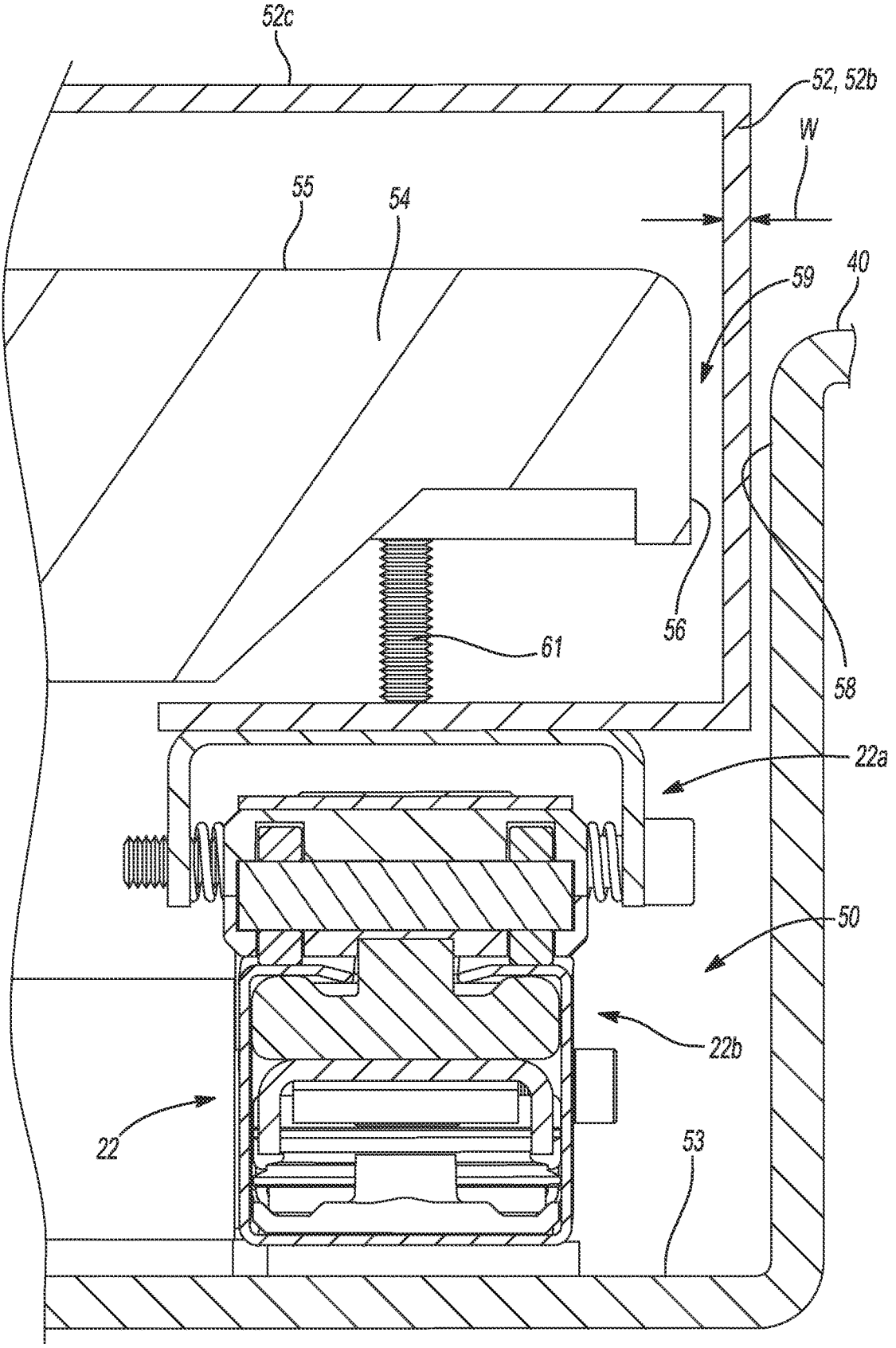
FIG. 6 is another cross-sectional elevation view of the portion 5B of FIG. 5A.

As illustrated in FIG. 5A, the bent plate 52 can be comprised of right and left lateral sections 52*a*, 52*b*, wherein each right and left lateral section 52*a*, 52*b* is supported by one or more of the track/slide systems 22. In particular, one or more fasteners (e.g., bolts 61) may couple the bent plate 52 to a first portion 22*a* of the track/slide system 22. The right lateral section 52*a* may be coupled to the left lateral section 52*b* at an upper wall or section 52*c* of the bent plate 52 such that the bent plate 52 defines a "C" shaped construct. In this regard, the floor panel 54 may be at least partially disposed within the bent plate 52, such that the floor panel 54 is disposed between the upper wall 52*c* and the right and left lateral sections 52*a*, 52*b*, respectively, of the bent plate 52 in a direction extending substantially perpendicular to the path 20. In some implementations, the cavity 50 is defined in part by a lower wall 53 extending substantially parallel to the deck 42, and the floor panel 54 is disposed between the lower wall 53 of the deck 42 and the upper wall 52*c* of the bent plate 52 in the direction extending substantially perpendicular to the path 20.

Figure 2:
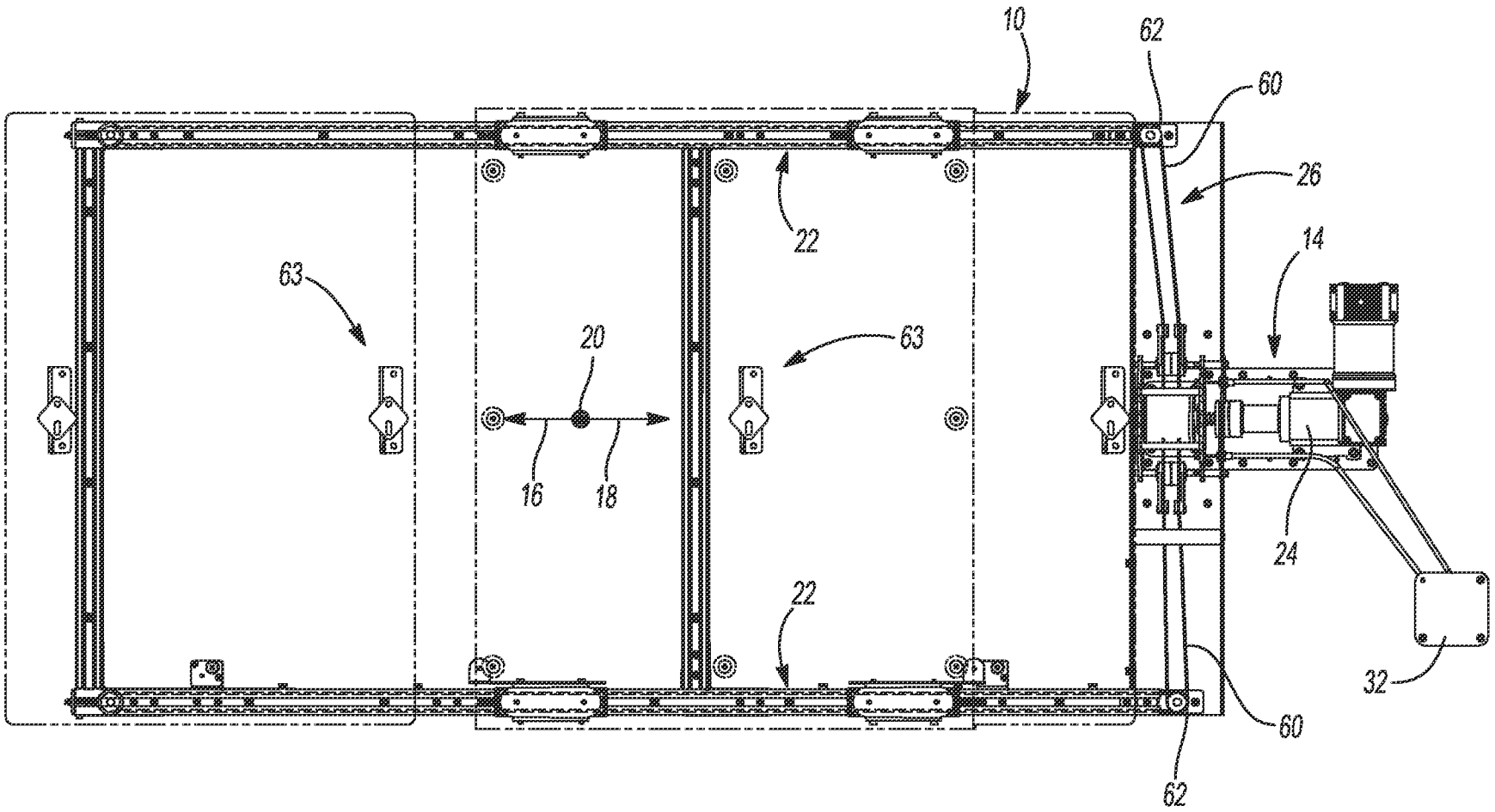
FIG. 2 is a schematic plan view of the slide system of FIG. 1.

The floor panel 54 hides the opening 51 above, and to, the below deck cavity 50. As illustrated in FIG. 2, in some implementations, the floor panel(s) 54 are coupled to the lower wall 53 of the deck 42 by one or more mechanical fasteners 63 (e.g., a U-bolt). Optionally, the floor panel 54 can be easily removed from the bent plate 52 by removing the one or more fasteners 63 for servicing the below deck drive mechanism 14. Optionally, the material thicknesses and geometries of the floor panel 54 are designed and/or sized such that the walking surface 40 is generally positioned at the same horizontal level as (e.g., coplanar with) an upper surface 55 of the floor panel 54. By arranging the floor panel 54, the walking surface 40, and the drive mechanism 14 in this manner, the floor panel 54, the walking surface 40, and the components (e.g., the drive motor 24, the drive linkage 26, and/or any other components of the below deck drive mechanism 14) do not present any trip hazards for the user.

Figure 4:
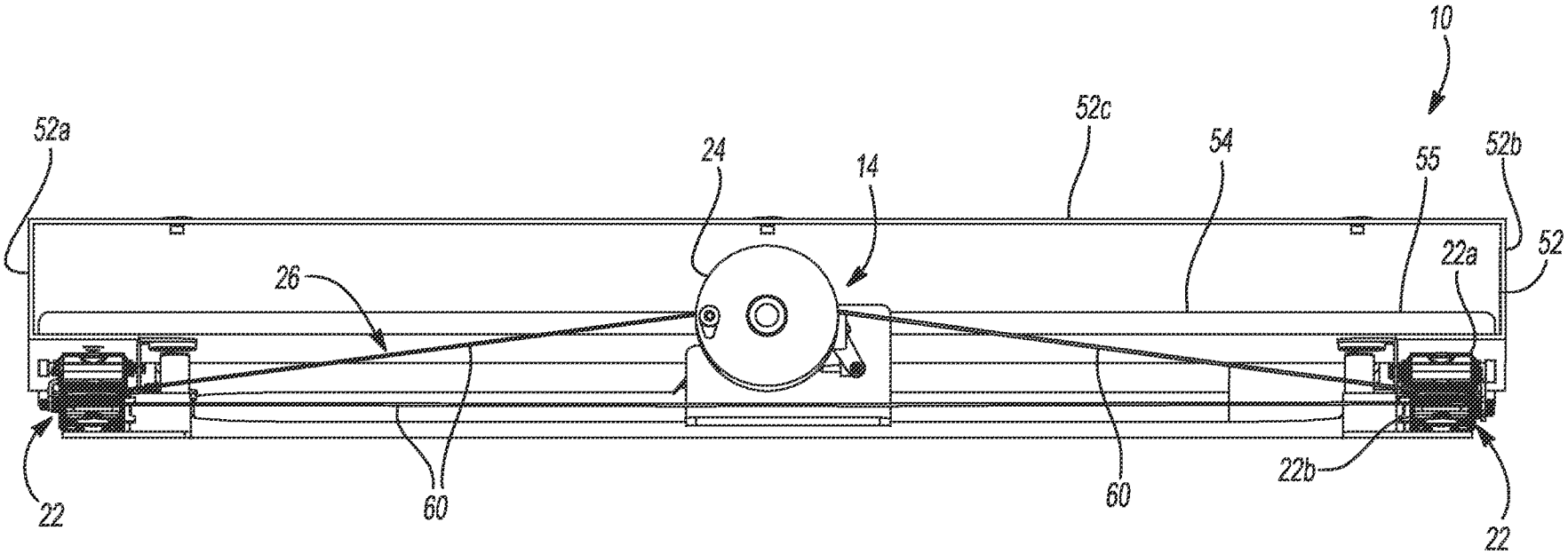
FIG. 4 is a schematic elevational view of another side of the slide system of FIG. 1.

With reference to FIGS. 2 and 4, the drive mechanism 14 and/or the associated drive linkage 26 may further include one or more cables 60 and one or more pulleys 62 coupled to the drive motor 24 and the track/slide system 22. In particular, a first end or portion of the cable(s) 60 may be coupled to the drive motor 24, while a second end or portion of the cable(s) 60 may be coupled to the first portion 22*a* of the track/slide system 22 that is translatably coupled to a second portion 22*b* of the track/slide system 22. In this regard, the first portion 22*a* of the track/slide system 22 may be coupled to the seat/entertainment system 12, while the second portion 22*b* of the track/slide system 22 may be coupled to the deck 42 or lower wall 53 or other portion of the vehicle 5 disposed within the cavity 50 such that actuation of the drive motor 24 increases or decreases the length of the cable(s) 60 and/or causes the cable(s) to translate along the pulley(s) 62. In this regard, as the cable(s) 60 translates along the pulley(s) 62 it may apply a force on the first portion of the track/slide system 22 and cause the first portion of the track/slide system 22 to translate relative to the second portion of the track/slide system 22. Translation of the first portion of the track/slide system 22 relative to the second portion of the track/slide system 22 can cause the support structure 52 to translate within the slit 59, and relative to the floor panel 54 and/or the deck 42, and cause the seat/entertainment system assembly 12 to translate along the path 20 in the forward direction 18 and/or the reverse direction 16.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A slide system for use in a vessel, the slide system comprising:

a component assembly;

a track system coupled at least indirectly to said component assembly for guiding movement of the component assembly along a path;

a floor panel defining a deck of the vessel, the floor panel having an upper surface; and a cavity disposed below the floor panel, wherein the component assembly is located substantially above the floor panel, and wherein the track system is located within the cavity and below the upper surface.

2. The slide system of claim 1, further comprising a drive mechanism at least indirectly coupled to the component assembly, wherein the component assembly is manipulatable along the path by the drive mechanism.

3. The slide system of claim 2, further comprising a motor operable to actuate the drive mechanism.

4. The slide system of claim 3, wherein the drive mechanism includes a cable coupled to the motor and the component assembly, the cable configured to move the component assembly relative to the floor panel.

5. The slide system of claim 1, wherein the component assembly includes at least one of a seat or an entertainment system.

6. The slide system of claim 1, wherein the track system includes a first portion and a second portion configured to translate relative to the first portion, the first portion fixed within the cavity, the second portion coupled to the component assembly for translation therewith.

7. The slide system of claim 1, wherein the floor panel at least partially defines a slit, the slide system further comprising a support structure coupled to the component assembly and the track system and at least partially disposed within the slit.

8. The slide system of claim 7, wherein the support structure includes a lateral section and an upper wall extending from the lateral section, at least a portion of the lateral section disposed below the upper surface, and the upper wall disposed above the upper surface.

9. The slide system of claim 8, wherein the floor panel is disposed between the upper wall and the cavity relative to a direction extending perpendicular to the path.

10. A slide system for use in a vessel, the slide system comprising:

a deck defining a cavity and an opening in communication with the cavity;

a floor panel covering a portion of the opening, the deck and the floor panel defining a slit;

a track system disposed within the cavity; and a support structure coupled to the track system and including a portion translatably disposed within the slit, the track system configured to move the portion of the support structure within the slit.

11. The slide system of claim 10, further comprising a component assembly coupled to the support structure, wherein the component assembly is located substantially above the floor panel, and wherein the track system is located below the floor panel.

12. The slide system of claim 11, wherein the component assembly includes at least one of a seat or an entertainment system.

13. The slide system of claim 10, further comprising a drive mechanism at least indirectly coupled to the support structure, wherein the support structure is manipulatable along a path by the drive mechanism.

14. The slide system of claim 13, further comprising a motor operable to actuate the drive mechanism.

15. The slide system of claim 14, wherein the drive mechanism includes a cable coupled to the motor and the support structure, the cable configured to move the support structure relative to the floor panel.

16. The slide system of claim 10, wherein the track system includes a first portion and a second portion configured to translate relative to the first portion, the first portion fixed within the cavity, the second portion coupled to the support structure for translation therewith.

17. The slide system of claim 16, wherein the support structure includes a lateral section and an upper wall extending from the lateral section, at least a portion of the lateral section disposed below the floor panel, and the upper wall disposed above the floor panel.

18. The slide system of claim 17, wherein the slit extends in a travel direction, and wherein the floor panel is disposed between the upper wall and the cavity relative to a direction extending perpendicular to the travel direction.

* * * * *